US007610957B2

(12) United States Patent
Davis et al.

(10) Patent No.: US 7,610,957 B2
(45) Date of Patent: Nov. 3, 2009

(54) DOWNHOLE DEBRIS CATCHER AND ASSOCIATED MILL

(75) Inventors: John P. Davis, Cypress, TX (US); James S. Trahan, Magnolia, TX (US); Paul L. Connell, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/029,228

(22) Filed: Feb. 11, 2008

(65) Prior Publication Data

US 2009/0200012 A1 Aug. 13, 2009

(51) Int. Cl.
*E21B 31/08* (2006.01)
*E21B 27/00* (2006.01)
*E21B 34/00* (2006.01)

(52) U.S. Cl. ..... 166/99; 166/162; 166/316

(58) Field of Classification Search ..... 166/99, 166/162, 316

See application file for complete search history.

(56) References Cited

U.S. PATENT DOCUMENTS

| | | | | | |
|---|---|---|---|---|---|
| 2,169,922 | A | * | 8/1939 | Notley | 166/99 |
| 2,220,989 | A | * | 11/1940 | Brauer | 166/99 |
| 2,556,849 | A | * | 6/1951 | Nolley et al. | 166/66.5 |
| 2,659,441 | A | * | 11/1953 | Knapp | 166/99 |
| 5,327,974 | A | | 7/1994 | Donovan et al. | |
| 5,944,100 | A | | 8/1999 | Hipp | |
| 6,024,168 | A | * | 2/2000 | Kuck et al. | 166/297 |
| 6,176,311 | B1 | | 1/2001 | Ryan | |
| 6,189,617 | B1 | * | 2/2001 | Sorhus et al. | 166/311 |
| 6,250,387 | B1 | * | 6/2001 | Carmichael et al. | 166/311 |
| 6,276,452 | B1 | | 8/2001 | Davis et al. | |
| 6,607,031 | B2 | | 8/2003 | Lynde et al. | |
| 2006/0011344 | A1 | * | 1/2006 | Lynde et al. | 166/298 |

OTHER PUBLICATIONS

Baker Oil Tools, Junk Retrieval Tools Information Sheet; 1 page; date unknown.

Haughton, D.B., et al., "Reliable and Effective Downhole Cleaning System for Debris and Junk Removal", SPE 101727, Sep. 2006, 1-9.

Connell, P., et al., "Removal of Debris for Deepwater Wellbores Using Vectored Annulus Cleaning System Reduces Problems and Saves Rig Time", SPE 96440, Oct. 2005, 1-6.

Joppe, L.C., et al., "Using High-Frequency Downhole Vibration Technology to Enhance Through-Tubing Fishing and Workover Operations", SPE 99415, Apr. 2006, 1-4.

* cited by examiner

*Primary Examiner*—Jennifer H Gay
*Assistant Examiner*—Yong-Suk Ro
(74) *Attorney, Agent, or Firm*—Steve Rosenblatt

(57) ABSTRACT

A debris catching device for downhole milling features modular debris receptacles that are held in the housing in a manner that facilitates stacking and a generally undulating flow path to facilitate dropping of the debris into the receptacles as the remaining fluid travels up the tool for ultimate screening before the fluid exits the tool to flow up to the surface or in a reverse circulation pattern back to the mill below the debris catcher. The modules can also be aligned with flapper valves at the top of each module to prevent debris in the tool from falling to the mill if circulation is turned off. The mill is configured to have an off-center return path preferably as large as the passage through the mill body to aid circulation and cutting performance.

15 Claims, 4 Drawing Sheets

DOWNHOLE DEBRIS CATCHER AND ASSOCIATED MILL

FIELD OF THE INVENTION

The field of this invention is downhole debris catching tools and more specifically those that reverse circulate into a mill to capture the cuttings as they come up through the tool.

BACKGROUND OF THE INVENTION

Milling Operations downhole generate cuttings that a captured in tools associated with a mill frequently referred to in the industry as junk catchers. There are many configurations for such tools. Some have external seals that direct cuttings coming up from a mill around the outside of the tool back into the tool so that the circulating fluid can exit while the debris is captured in the tool body. Examples of this design are U.S. Pat. Nos. 6,176,311 and 6,607,031. Another design involves establishing a reverse circulation with jets that discharge outside a tool body toward a mill below and act as eductors to draw fluids through the mill and into a screened section central passage. Once the debris laden fluid exits the central passage the velocity slows and debris drops into an annular passage and the fluid keeps going toward the top of the tool. On the way out the top the remaining debris is left on a screen and can drop into the same annular space that caught the larger debris further down the tool as the now screened fluid is drawn by the jets at the top of the tool to go right back down around the outside of the tool toward the mill so that the cycle can repeat.

FIG. 1 illustrates the basics of this known design. A mill 10 generates cuttings that are removed with reverse circulation that goes up passage 12 and exits at 14 into a wide spot 16 in the tool body 18. The heavier debris falls into annular space 20 around the passage 12 while the fluid stream with some smaller debris continues up the tool body 18 until it reaches a screen 22. The debris remaining is caught outside the screen 22 and eventually falls to annular space 20. The clean fluid is drawn by the jets 24 fed by fluid pumped from the surface through a string (not shown). Exhaust from the jets 24 combined with fluid drawn by those jets now goes back down around the tool body 18 toward mill 10 and the rest goes up to the surface outside the tubular string that runs from the surface (not shown).

FIG. 2 shows a detail of the junk catcher of FIG. 1. What is depicted is the lower end just above the mill 10. A threaded connection 26 holds the bottom sub 28 to the tool body 18. Debris 30 typically falls down in annular space 20 and wedges tube 32 that defines the passage 12 and prevents the ability to relatively rotate the bottom sub 28 with respect to body 18 to get the threaded connection 26 to let loose. That threaded connection 26 has to get undone so that the debris 30 can get flushed out of the tool when it is brought to the surface. Note that the tube 32 is attached to the bottom sub 28 and in the past efforts to get the threaded connection undone have sheared the tube 32 or have otherwise caused it to crack or fail when debris 30 got compacted in annular space 20.

Another issue was that tube 32 was prefabricated to a predetermined length which limited the volume of the annular space 20. Yet another issue occurred when the surface pumps were shut off and debris on the screen 22 can fall through the hat 34 through the side openings 36 under it.

Turning now to FIG. 7, a detailed view of the mill 10 from FIG. 1 is shown with a central passage 38 leading to circulation outlets 40 four of which can be seen in the associated bottom view. Passages 40 are far smaller than passage 38 that feeds them. This layout worked well for normal downhole milling with circulation going down passage 38 to outlets 40 when a tool or other wellbore obstruction was milled out in a traditional way. However, in conjunction with the debris catcher shown in FIG. 1 there was a problem since the circulation patterns are reversed for the debris catcher in FIG. 1 and cuttings are reverse circulated into the body of mill 10 which leads to plugging of the passages 40. The mills of FIG. 7 had blades 42 featuring inserts 44 and textured carbide faces in between to assist in the milling operation.

The present invention provides for greater capacity variation for the tool illustrated in FIG. 1 leading to a modular design with passages that feature dog legs to promote dropping of debris into annular catch volumes located below dog legs. An alternative uses a modular approach with aligned modules that have flapper valves that can fall shut when circulation stops to prevent debris from falling back to the mill. The mill configuration has been changed to accommodate reverse circulation without the plugging issues of prior designs illustrated in FIG. 7. These and other aspects of the present invention will be more apparent to those skilled in the art from a review of the description of the preferred embodiments and associated drawings that appear below while understanding that the full scope of the invention is given by the claims.

SUMMARY OF THE INVENTION

A debris catching device for downhole milling features modular debris receptacles that are held in the housing in a manner that facilitates stacking and a generally undulating flow path to facilitate dropping of the debris into the receptacles as the remaining fluid travels up the tool for ultimate screening before the fluid exits the tool to flow up to the surface or in a reverse circulation pattern back to the mill below the debris catcher. The modules can also be aligned with flapper valves at the top of each module to prevent debris in the tool from falling to the mill if circulation is turned off. The mill is configured to have an off-center return path preferably as large as the passage through the mill body to aid circulation and cutting performance.

DETAILED DESCRIPTION OF THE PREFERRED EMBODIMENT

Figure 4:
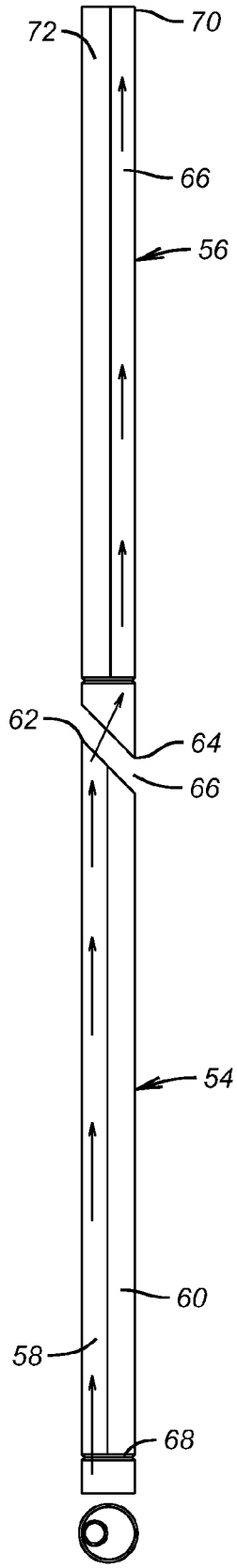
FIG. 4 is a detailed view of two modules shown in FIG. 3.
Figure 5:
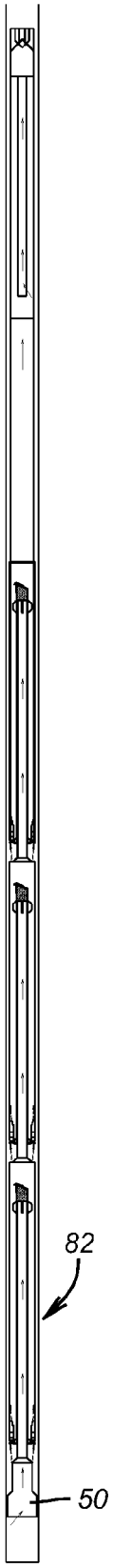
FIG. 5 shows an aligned modular design featuring flapper type valves at the top of each module.

FIG. 5 shows a mill 50 with one embodiment of the debris catching tool 52 mounted above it. In this embodiment there are modules 54 and 56 shown in housing 55 although additional modules can be used. The modules 54 and 56 are shown in larger scale in FIG. 4 and without the housing 55 so that the flow pattern can be more easily seen. Debris laden fluid from the mill 50 enters passage 58 in module 54. Sitting beside passage 58 is passage 60 with both passages open at the upper end 62 of module 54. Upper end 62 is beveled and lower end 64 of module 56 is also beveled in a conforming way leaving a gap 66 between ends 62 and 64. Passage 58 continues up the tool into passage 66 of module 56. Passage 60 in module 54 has a closed bottom 68. When debris laden fluid exits passage 58 at the top 62 the velocity slows and the fluid stream has to negotiate a double bend to continue into passage 66. The combination of a slowing velocity and making the double bend to a position over the passage 60 allows debris to fall into passage 60 where they are collected until the tool 52 is removed to the surface.

Figure 3:
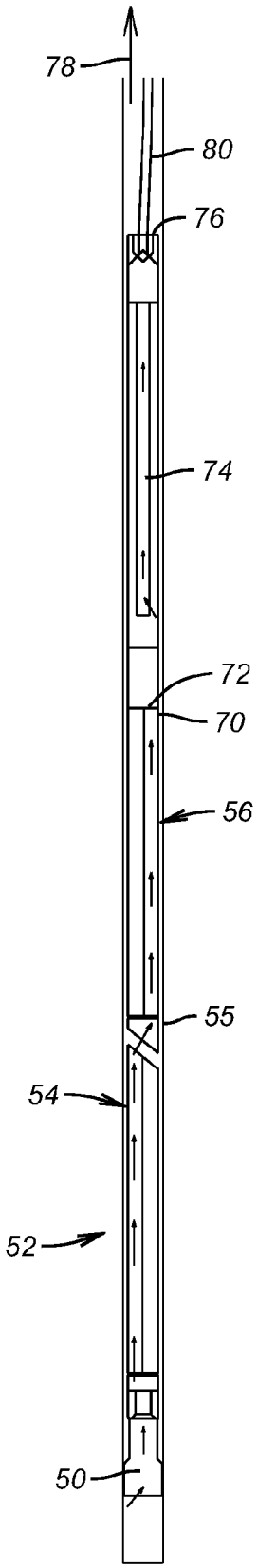
FIG. 3 is one version of a modular design of internals for debris catching showing an undulating flow path up the tool body.

Meanwhile flow continues up the tool 52 through passage 66 until the fluid stream reaches the upper end 70 where there is another velocity reduction so that any even lighter debris still being taken along can have another chance to drop out into passage 72 that has a closed bottom 74 all of which are part of module 56. Note that the upper end 70 is squared off rather than beveled because in this example it is the top module. The idea is that between modules there is a cross-over effect to allow the combination of reduction of velocity by entering a larger cross-section area of the tool to work in conjunction with gravity to let the debris fall down into a receptacle in position right below the flowing stream. After the flowing stream passes the upper end 70 it enters an enlarged cross-section zone 72, shown in FIG. 3. It then goes through a screen 74 and is then drawn by eductors 76 whose exhaust goes two ways; uphole in an annular space represented by arrow 78 or downhole around the annular space outside the tool body 52 toward the bit 50. String 80 feeds fluid to the eductor jets 76 as the process of milling continues and ultimately the tool 52 is removed from the well and taken apart at joints that are disposed between the modules such as 54 and 56.

Figure 1:
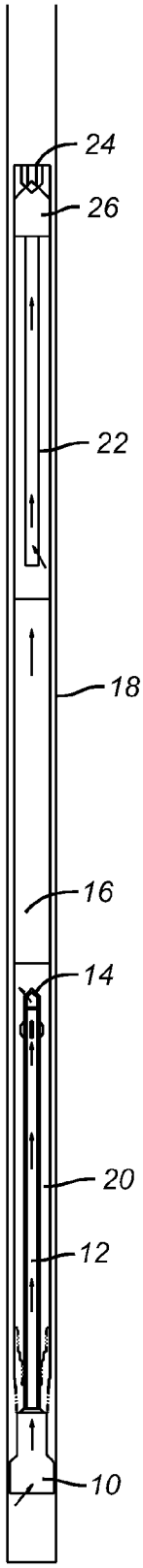
(PRIOR ART) FIG. 1
FIG. 1 is a section view of an existing design of a debris catcher that uses reverse circulation flow patterns.
Figure 2:
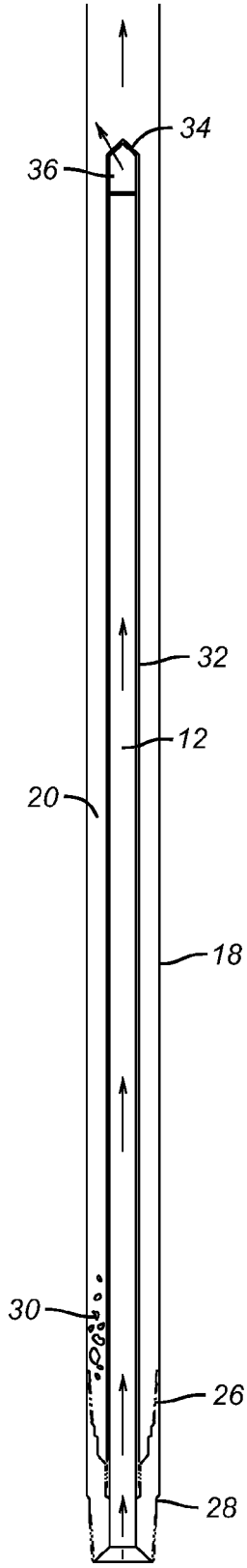
(PRIOR ART) FIG. 2
FIG. 2 is a detailed view of the lower end of FIG. 1 showing the way the single debris catching structure and the passage along side of it and the manner of its fixation to the housing.
Figure 6:
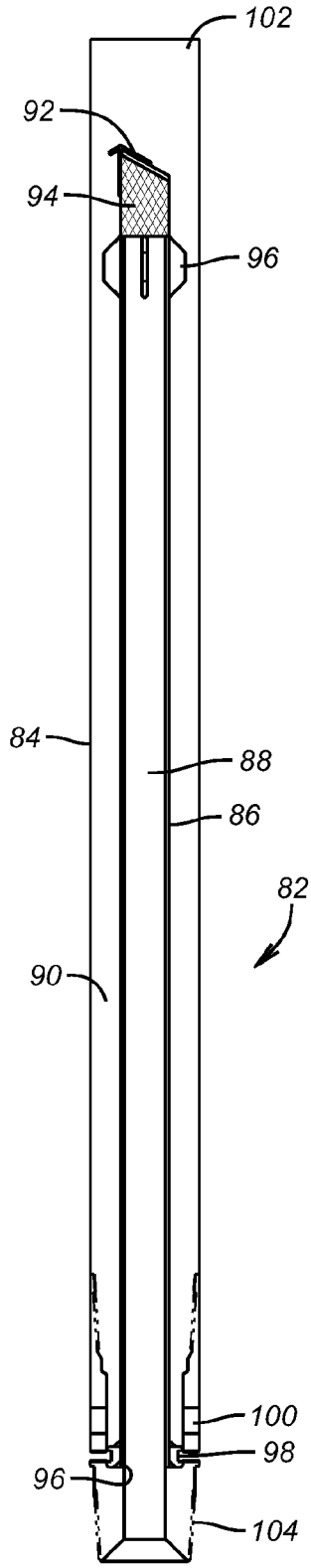
FIG. 6 is a further detailed view of the module of FIG. 5 showing how it is attached to the tool body.

The preferred fixation technique is shown in FIG. 6 although it is in the context of a different modular design. FIGS. 5 and 6 go together as an alternative modular design. The lowest module 82 is shown in both Figures and is typical of the preferred attachment system for each module. As shown in FIG. 6 the tool housing 84 surrounds the tube 86. In this embodiment there is but a single passage 88 in tube 86 with the debris caught in annular space 90 after the fluid stream pushes open the flapper valve 92 located above a screen section 94. Centralizers 96 can be mounted to tube 86 to keep the annular space 90 around the tube 86 reasonably uniform in dimension over the length of tube 86. Tube 86 terminates at 96 and just above that location one or more set screws or fasteners 98 are threaded through the housing 84. A plugged cleanout hole 100 is also provided. At the surface after milling, the housing 84 is broken out at its top 102 and near its bottom at thread 104. The plugged cleanout 100 is opened to flush debris out as much as possible to end 102. After that is done the set screws or fasteners 98 are undone and the tube 86 should come right out. Since the tube 86 from its lower end 96 to the flapper 92 is only held in housing 84 with the set screws 98 its release is far simpler than the prior design shown in FIG. 2 where the tube was integral to a sub 28 that was threaded at 26 and the presence of compacted debris around the tube 20 either damaged the tube or the threaded connection 26 as efforts were made to undo it.

The modular design of FIGS. 5 and 6 with preferably centrally mounted modules with a screen 94 and a flapper 92 is designed to let flow go backwards bypassing the closed flapper 92 and going through the screen 94, if circulation is cut off so that debris can still settle in the annular space 90 around each module and the liquid can go through the screen 94 because the flappers 92 are all closed and run out the mill 50 as the tool 52 is pulled out of the hole. While the tubes 86 are shown in their preferably centralized orientation, they can be offset from each other as well.

Figure 8:
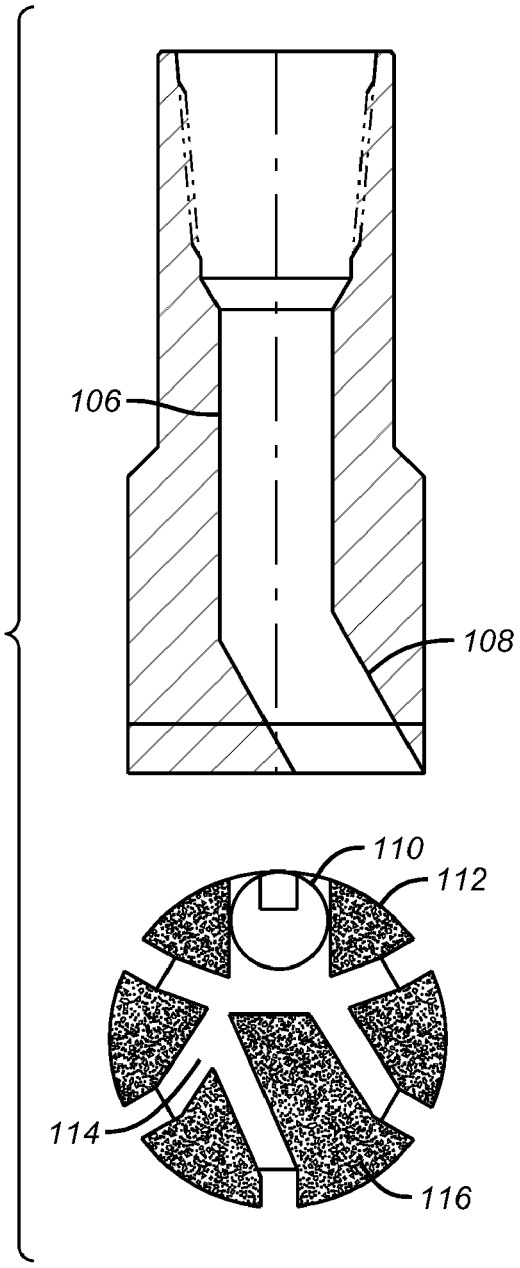
FIG. 8 is a section and an end view of a mill that can be used in conjunction with a debris catcher, for example, as shown in FIG. 3 or 5.
Figure 7:
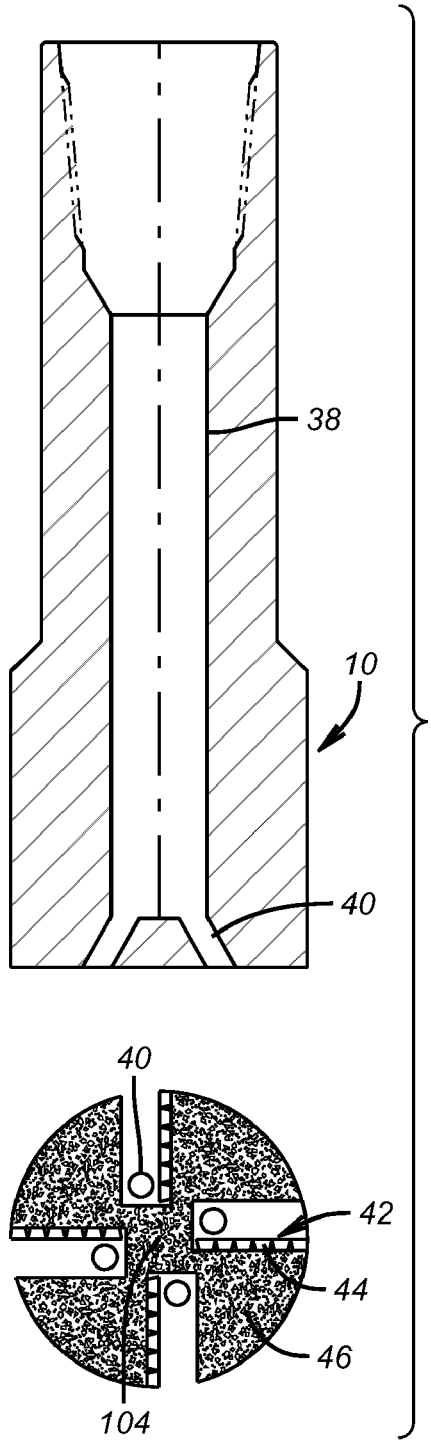
(PRIOR ART) FIG. 7
FIG. 7 is a section and end view of a mill used in conjunction with a debris catching device such as is shown in FIGS. 1 and 5.

Turning now to the design of the mill and FIGS. 7 and 8, as mentioned before the problem with the FIG. 7 design was that the outlets 40 would clog with debris which could overheat or simply just stall the mill in a tangle of cuttings. Another issue with the former design was that the blades 42 come short of the center 104 leaving just an array of ground carbide particles in that region. When milling out a packer, for example, the effect was uneven milling. Mills that simply used a central bore to accept reverse circulation flow when milling suffered from having no milling going on near their centers so as to leave a core of un-milled tool as the cutting progressed. The mill of the present invention in FIG. 8 has a main bore 106 preferably centrally located with a bend 108 so that the entrance for cuttings 110 is near the circumference 112. A network of passages 114 directs the cuttings from the action of the carbide particle arrays 116 to the entrance 110. The passages 114 also direct reverse circulating fluid coming down outside the tool into the entrance 110. There are two main advantages of this design. One is that the entrance 110 is close to or even larger than the bore 106 to reduce if not eliminate the problem of balling up of cuttings in the FIG. 7 design from small inlets 40 as compared to the main passage above them 38. Another advantage is that the offset inlet 110 allows for particle arrays 116 otherwise on the periphery at circumference 112 to take up the slack of a missing portion of cutting structure at or near the periphery to still get effective milling at the periphery as opposed to locating the inlet in the center which would contribute to a no milling zone or a coring effect of milling the exterior of a downhole tool without the center.

Those skilled in the art will appreciate that the improvements to the debris catching tool using the modular designs makes them more likely to come apart at the surface for cleaning when laden with cuttings that could be compacted. A plugged cleanout 100 allows an initial attempt to flush the cuttings clear of a surrounding modular housing before undoing the set screws 98 to allow removal with a pull out force at the opposite end such as near the centralizers 96. The modular design can incorporate a flow path with a debris receptacle in each module and a sinuous path for flow coupled with sudden enlargements of the flow area where the bends are so that the reduced velocity will act with gravity to allow the debris to drop straight down to an aligned debris receptacle in a given module below. Alternatively, using modules as shown in FIG. 6 the flow can come straight up through the modules and due to gaps between the modules where the velocity slows debris can still fall away and be pushed to the periphery when it will fall down into the annular collection area in part made possible by centralizers 96 around the tube 86. When there is no circulation, the flappers 92 close and drainage to the mill 50 can occur through the screens 94 in each module. In that way a wet string is not pulled and debris is not permitted to fall back into the mill 50 when circulation stops. The mill reduces clogging with debris with the inlet 110 as large as or larger than the bore 106 and the offset from center location of it allows adjacent cutting structure near the periphery to compensate for the zone of missing cutting structure where the inlet 110 is located. This reduces the coring effect as compared to prior designs with central inlets.

The use of a modular design allows the ability to match the expected level of cuttings with the storage capacity to hold them until the milling is done. The mounting technique facilitates removal when the tool is laden with cuttings with minimal risk of damage to the modules and rapid reassembly is facilitated.

The above description is illustrative of the preferred embodiment and many modifications may be made by those skilled in the art without departing from the invention whose scope is to be determined from the literal and equivalent scope of the claims below.

We claim:

1. A debris catcher assembly for downhole use in a wellbore to separate debris from moving fluid, comprising:

an enclosed body located in the wellbore having a lower end and an upper end and comprising a plurality of enclosed modules arranged in series to define an inlet flow path internal to said enclosed body to accept fluid with debris therethrough into said flowpath and debris catchers located within said modules and offset from said flowpath for accumulation of debris as the fluid flows through said flowpath.

2. The assembly of claim 1, wherein:

said modules are removably mounted to each other.

3. The assembly of claim 2, wherein:

said modules are secured with at least one removable fastener extending through said body.

4. The assembly of claim 3, wherein:

said body comprises a cleanout access adjacent said fastener.

5. The assembly of claim 2, wherein:

said flowpath bends or is aligned between at least two said modules.

6. The assembly of claim 5, wherein:

said flowpath is aligned as between at least two modules and said modules comprise a one way valve and an adjacent screen to allow bypass of said valve when it is in the closed position.

7. The assembly of claim 5, wherein:

said modules are secured with at least one set screw extending through said body.

8. The assembly of claim 1, wherein:

said flowpath bends between modules.

9. The assembly of claim 8, wherein:

at least two modules define a passage and an aligned debris collection component.

10. The assembly of claim 1, wherein:

said flowpath is aligned between modules.

11. The assembly of claim 10, wherein:

at least two modules are tubular and define a debris collection space around said tubular and within said body.

12. The assembly of claim 11, wherein:

said modules comprise a one way valve and an adjacent screen to allow bypass of said valve when it is in the closed position.

13. The assembly of claim 1, wherein:

said body comprises a mill having a main bore and a debris inlet at least as large as said main bore.

14. The assembly of claim 1, wherein:

said body comprises a mill having a main bore and a debris inlet offset with a bend from said main bore.

15. The assembly of claim 14, wherein:

said inlet is located adjacent the outer periphery of said mill.

* * * * *